US009135844B2

(12) United States Patent
Lin et al.

(10) Patent No.: US 9,135,844 B2
(45) Date of Patent: Sep. 15, 2015

(54) OPTICAL PROJECTION SYSTEM CAPABLE OF DETECTING PROJECTION IMAGE DEFORMATION AND ASSOCIATED DETECTION METHOD

(71) Applicant: LITE-ON IT CORPORATION, Taipei (TW)

(72) Inventors: Wen-Lung Lin, Hsinchu (TW); Hua-De Lei, Hsinchu (TW)

(73) Assignee: LITE-ON TECHNOLOGY CORPORATION, Taipei (TW)

( * ) Notice: Subject to any disclaimer, the term of this patent is extended or adjusted under 35 U.S.C. 154(b) by 155 days.

(21) Appl. No.: 13/909,210

(22) Filed: Jun. 4, 2013

(65) Prior Publication Data

US 2014/0132579 A1 May 15, 2014

(30) Foreign Application Priority Data

Nov. 9, 2012 (CN) ..... 2012 1 0447492

(51) Int. Cl.
*G09G 3/00* (2006.01)

(52) U.S. Cl.
CPC ..... *G09G 3/001* (2013.01); *G09G 3/002* (2013.01); *G09G 2320/068* (2013.01); *G09G 2320/0693* (2013.01)

(58) Field of Classification Search
CPC ... G09G 3/001; G09G 3/00; G09G 2360/144; G09G 2320/0626; G09G 3/20; G09G 2320/0693; G09G 2320/068; G09G 3/002
USPC ..... 345/207
See application file for complete search history.

(56) References Cited

U.S. PATENT DOCUMENTS

| | | | | |
|---|---|---|---|---|
| 6,974,217 | B2 * | 12/2005 | Kimura et al. | 353/69 |
| 2012/0120116 | A1 * | 5/2012 | Seo et al. | 345/690 |
| 2013/0070213 | A1 * | 3/2013 | Chikaoka | 353/69 |

* cited by examiner

*Primary Examiner* — Towfiq Elahi
(74) *Attorney, Agent, or Firm* — Rabin & Berdo, P.C.

(57) ABSTRACT

An optical projection system capable of detecting projection image deformation is provided. The optical projection system includes a laser source system, a scan unit, a detection unit and a signal control processing unit. The laser source system generates a visible laser having a visible wavelength and a detection laser. The scan unit projects the visible laser and the detection laser onto a projection plane, and drives the visible laser and the detection laser to scan along multiple scan lines to form a projection image. The detection unit detects the detection laser reflected by the projection plane, and outputs a voltage signal. The signal control processing unit determines whether the projection image is deformed according to the voltage signal, and accordingly determines whether to perform a correction operation.

12 Claims, 5 Drawing Sheets

OPTICAL PROJECTION SYSTEM CAPABLE OF DETECTING PROJECTION IMAGE DEFORMATION AND ASSOCIATED DETECTION METHOD

This application claims the benefit of People's Republic of China application Serial No. 201210447492.X, filed Nov. 9, 2012, the subject matter of which is incorporated herein by reference.

BACKGROUND OF THE INVENTION

1. Field of the Invention

The invention relates in general to an optical projection system capable of detecting projection image deformation, and more particularly to an optical projection system capable of determining whether a projection image is deformed through detecting a voltage signal of a reflected laser and an associated detection method.

2. Description of the Related Art

Current projectors may be applied in various circumstances, such as being fixed to a location in a conference room or a room of other uses, or as being placed removably on a table. Regardless of the application circumstances, current projectors require a manual manipulation for adjusting a status of a projection image.

A projection image suitable for viewing is a rectangle, and so projectors are commonly designed to project rectangular projection images. However, deformation of a projection image is often caused in the event of a relative tilt angle between the projector and a projection plane. A user is required to manually adjust the shape of the projection image at this point in order to restore the projection image to a rectangle or to mitigate the deformation of the projection image. Such correction is generally referred to as "keystone correction".

Along with progresses in technologies, a volume of projectors is constantly miniaturized such that a projector may be apt as a component in a portable device, e.g., a portable handset, a camera, a video camera or a laptop computer. When such miniaturized projector is employed in the above portable devices, a relative tilt becomes more even liable between the miniaturized projector and a projection plane. Thus, complications and an impracticability issue may arise if the keystone correction is still to be performed manually.

SUMMARY OF THE INVENTION

The invention is directed to an optical projection system with an auto-correction function for a projection image. The optical projection system determines whether a projection image is deformed through detecting a voltage signal of a laser reflected from a projection plane, and determines whether to perform a correction operation according to a determination result.

According to an aspect of the present invention, an optical projection device capable of detecting projection image deformation is provided. The optical projection system includes a laser source system, a scan unit, a detection unit and a signal control processing unit. The laser source system emits at least one laser having a visible wavelength and a detection laser. The scan unit projects and scans the laser having the visible wavelength and the detection laser emitted from the laser source system onto a projection plane. The detection unit detects the detection laser reflected by the projection plane, and outputs a voltage signal. The signal control processing unit determines whether a projection image is deformed according to the received voltage signal, and accordingly determines whether to perform a correction operation.

According to another aspect of the present invention, a method for detecting projection image deformation for an optical projection system is provided. The method includes: projecting a detection laser onto a projection plane, and driving the detection laser to scan along a plurality of scan lines to form a projection image; detecting the detection laser reflected by the projection plane, and outputting a voltage signal; and determining whether the projection image is deformed according to the voltage signal, and accordingly determining whether to perform a correction operation.

The above and other aspects of the invention will become better understood with regard to the following detailed description of the preferred but non-limiting embodiments. The following description is made with reference to the accompanying drawings.

DETAILED DESCRIPTION OF THE INVENTION

Figure 1:
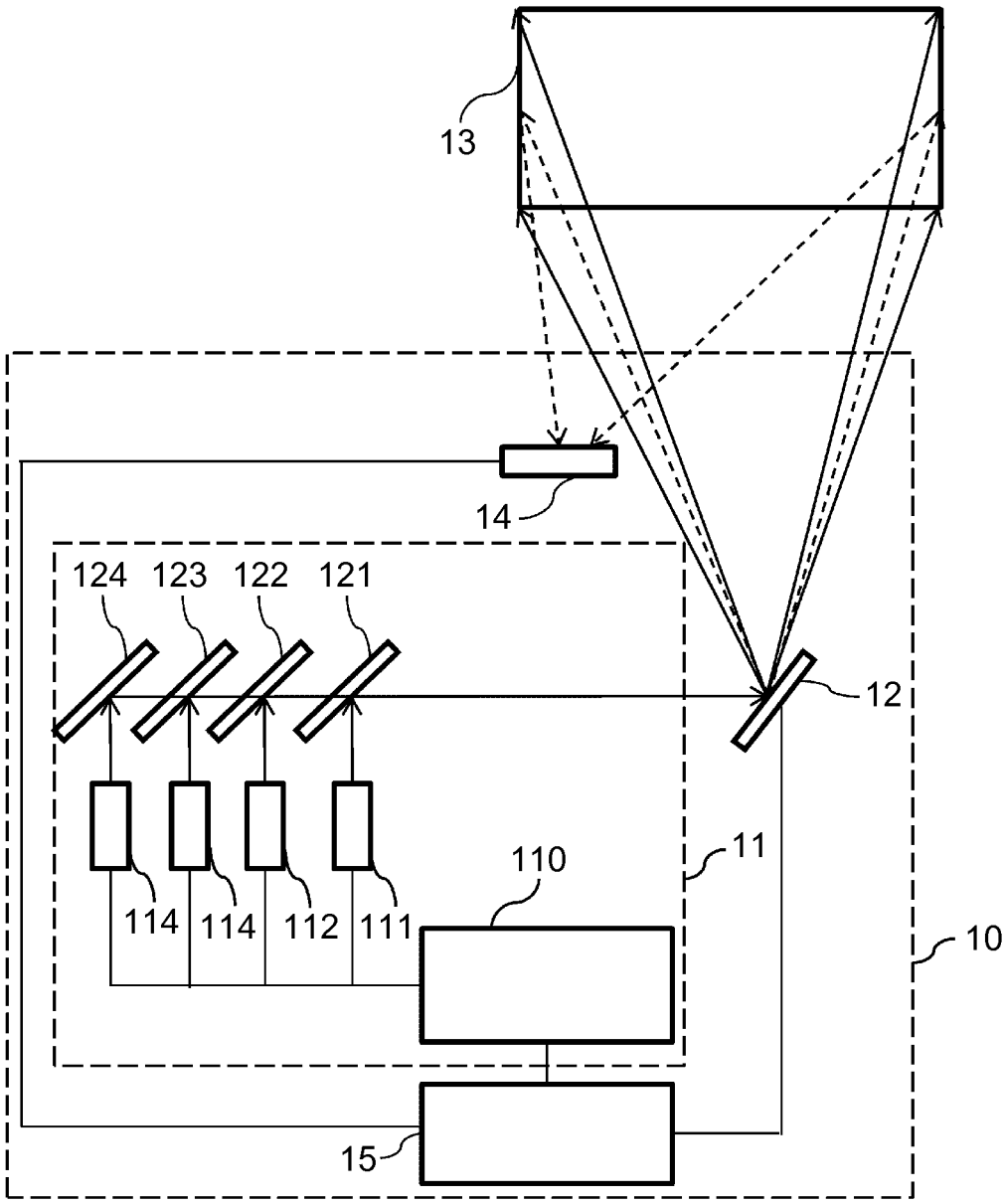
FIG. 1 is a schematic diagram of an optical projection system according to an embodiment of the present invention.

FIG. 1 shows a schematic diagram of an optical projection system according to an embodiment of the present invention. An optical projection system 10 includes a laser source system 11, a scan unit 12, a detection unit 14, and a signal control processing unit 15. The laser source system 11 emits at least one laser having a visible wavelength and a detection laser. The scan unit 12 projects and scans the at least one laser having the visible wavelength and the detection laser emitted from the laser source system 11 onto a projection plane 13. The detection unit 14 receives/detects the detection laser reflected from the projection plane 13, and outputs a voltage signal to the signal control processing unit 15. The signal control processing unit 15 determines whether a projection image projected onto the projection plane 13 is deformed according to the received voltage signal to accordingly determine whether to perform a correction operation.

In an embodiment of the present invention, the laser source system 11 includes a plurality of first laser diodes 111, 112 and 113, and a second laser diode 114. The first laser diodes 111, 112 and 113 respectively emits a laser having a visible wavelength, which passes through the scan unit 12 to be projected onto the projection plane 13 to form the projection image. The second laser diode 114 emits a detection laser, which passes through the scan unit 12 and is scanned and projected onto the projection plane 13. The detection laser projected onto the projection plane 13 is reflected by the projection plane 13 and then received by the detection unit 14.

In a preferred embodiment, the first laser diodes 111, 112 and 113 include a blue laser diode 111, a green laser diode 112 and a red laser diode 113; the second laser diode 114 is an infrared laser diode 114 for emitting a detection laser having an invisible wavelength.

In an embodiment of the present invention, the laser source system 11 further includes a laser source control unit 110 and a plurality of optical adjustment units 121, 122, 123 and 124. The laser source control unit 110 outputs a control signal to the first and second laser diodes 111 to 114 to control the first and second laser diodes 111 to 114 to respectively emit the lasers having the visible wavelength and the detection laser. The optical adjustment elements 121 to 124 adjust optical paths of the lasers having the visible wavelength and the detection laser to project the lasers having the visible wavelength and the detection laser to the scan unit 12.

In an embodiment of the present invention, the scan unit 12, e.g., a two-dimensional MEMS scanning mirror, projects the lasers emitted from the laser source system 11 onto the projection plane 13, and drives the lasers to scan back-and-forth on the projection plane 13 to form a projection image. The scan unit 12 may drive the lasers to scan back-and-forth along horizontal and vertical directions on the projection plane 13, with a horizontal scan frequency being greater than a vertical scan frequency. For example, the horizontal scan frequency is 18 kHz, and the vertical scan frequency is 60 Hz. In an alternative embodiment, the vertical scan frequency may also be set to be greater than the horizontal scan frequency according to different application requirements.

In an embodiment of the present invention, the scan unit 12 simultaneously projects and scans the lasers having the visible wavelength and the detection laser onto the projection plane 13. As the detection laser is a laser having an invisible wavelength imperceptible by human eyes, e.g., an infrared beam, presentation of the projection image may remain unaffected even with the presence of the detection laser.

In an embodiment of the present invention, the detection unit 14 is an optical detector, which receives the detection laser reflected from the projection plane 13, and outputs a voltage signal to the signal control processing unit 15 according to an intensity of the reflected detection laser. In an embodiment where the detection laser is an infrared beam, the detection unit 14 is correspondingly an infrared detector. A relationship between the voltage signal outputted by the detection unit 14 and projection image deformation is further illustrated below.

Figure 2:
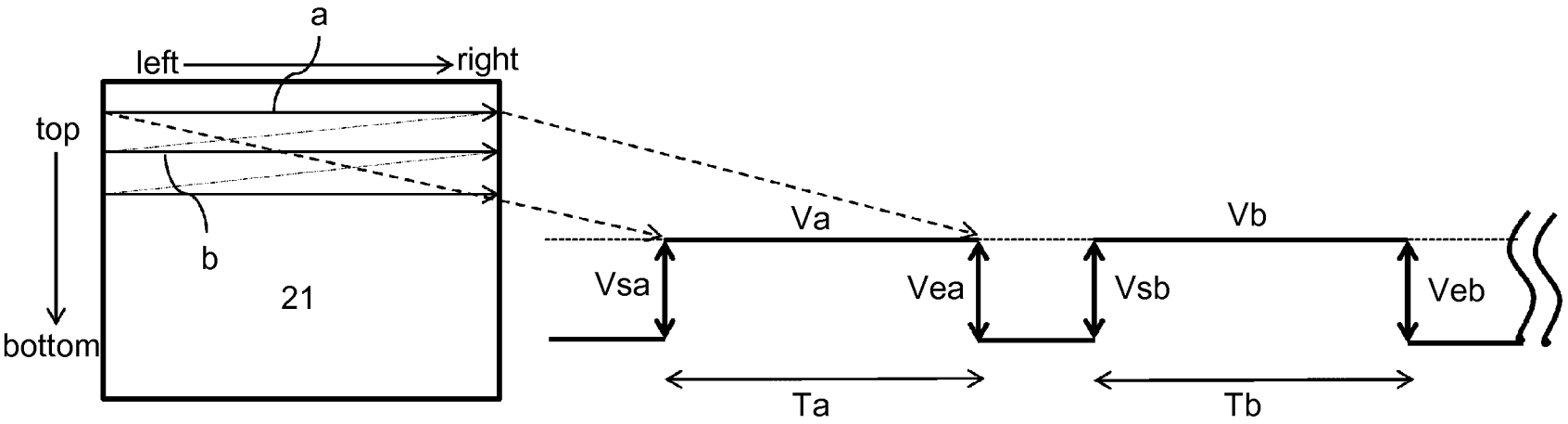
FIG. 2 is a schematic diagram of a relationship between a normal projection image and a voltage signal from a detection unit according to an embodiment of the present invention.

FIG. 2 shows a schematic diagram of a relationship between a normal projection image and a voltage signal outputted by a detection unit according to an embodiment of the present invention.

In an embodiment of the present invention, it is regarded that no relative tilt is present between the laser emitted from the optical projection system 10 and the projection plane 13 when the projection image is a normal projection image. As shown in FIG. 2, a projection image 21 is a normal projection image, e.g., a common rectangle projection image having a length-width ratio of 16:9 or 4:3. However, the length-width ratio may vary according to different image data for optimal viewing effects.

As previously stated, the scan unit 12 drives the detection laser to scan back-and-forth along the horizontal and vertical directions on the projection plane 13. A scan period for each scan line is constant due to a constant swing angle of the scan unit 12. As shown in FIG. 2, it is assumed that Ta is the scan period of a scan line a, a scan line b is a scan line following the scan line a, Tb is the scan period of the scan line b, and the scan period Ta equals the scan period Tb. Referring to FIG. 2, in an embodiment of the present invention, the scan line b is a next scan line immediately following the scan line a. In an alternative embodiment, the scan line b may be any scan line subsequent to the scan line a. Further, when the detection laser scans on the projection plane 13 along a single scan line, the detection laser reflected by the projection plane 13 is received by the detection unit 14, and a voltage signal is generated within the scan period of the scan line, as shown in FIG. 2.

In an embodiment of the present invention, the voltage signal corresponding to each scan line has a starting voltage level Vs and an ending voltage level Ve. The starting voltage level Vs corresponds to a starting position of the scan line, and the ending voltage level Ve corresponds to an ending position of the scan line. As shown in FIG. 2, the voltage signal Va corresponding to the scan line a has a starting voltage level Vsa and an ending voltage level Vea, which respectively correspond to the starting position and the ending position of the scan line a. The voltage signal Vb corresponding to the scan line b has a starting voltage level Vsb and an ending voltage level Veb, which respectively correspond to the starting position and the ending position of the scan line b.

In the example in FIG. 2, when the projection image 21 is a normal projection image, it is regarded that no relative tilt is present between the laser emitted from the optical projection system 10 and the projection plane 13. Thus, when the detection laser scans on the projection plane 13, distances of paths between different positions at which the detection laser is reflected on the projection plane 13 and the detection unit 14 receiving the reflected detection laser may be considered equal. Therefore, the intensities of the detection laser received by the detection unit 14 are substantially equal, and the levels of the voltage signals correspondingly outputted are also substantially equal.

In other words, when the detection laser driven by the scan unit 12 scans along the scan line a on the projection plane 13, the intensities of the detection laser received within the scan period Ta corresponding to the scan line a are substantially equal, and a waveform of the output voltage signal Va may be regarded as a horizontal waveform. Hence, the starting voltage level Vsa and the ending voltage level Vea of the voltage signal Va corresponding to the scan line a are substantially equal, as shown in FIG. 2. Similarly, when the detection laser driven by the scan unit 12 scans along the scan line b on the projection plane 13, the intensities of the detection laser received by the detection unit 14 within the scan period Tb corresponding to the scan line b are substantially equal, and a waveform of the output voltage signal Vb may be regarded as a horizontal waveform. Hence, the starting voltage level Vsb and the ending voltage level Veb of the voltage signal Vb corresponding to the scan line b are substantially equal, as shown in FIG. 2.

Further, in a normal projection image, not only the starting voltage level and ending voltage level of the voltage signal of a single scan line are substantially equal, but also an average voltage level of the voltage signals of the scan lines are substantially equal. In other words, the starting voltage level Vsa of the voltage signal Va corresponding to the scan line a is substantially equal to the starting voltage level Vsb of the voltage signal Vb corresponding to the scan line b. Similarly, the ending voltage level Vea of the voltage signal Va corresponding to the scan line a is substantially equal to the ending voltage level Veb of the voltage signal Vb corresponding to the scan line b.

Figure 3:
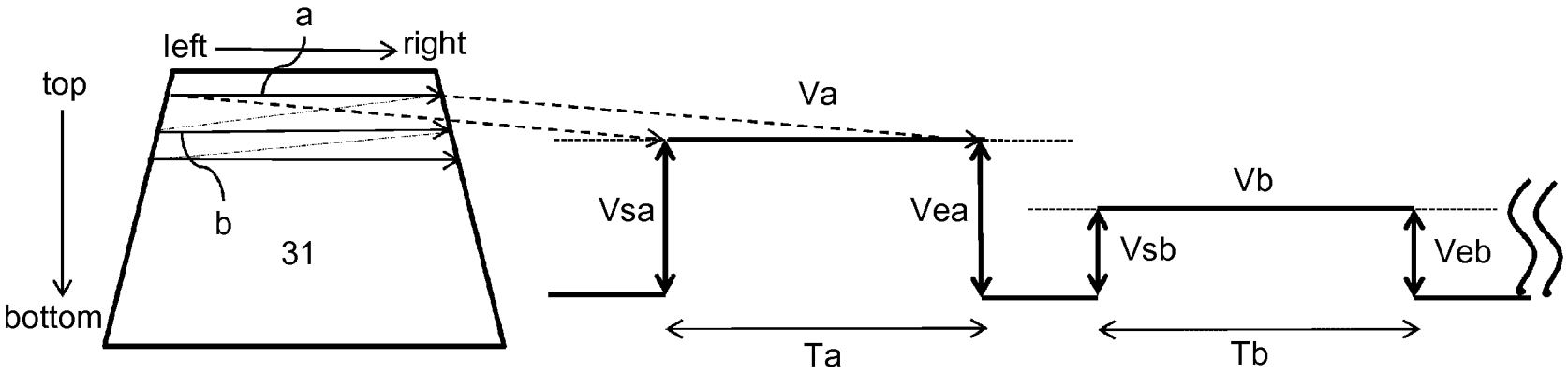
FIG. 3 is a schematic diagram of a relationship between a first type of projection image deformation and a voltage signal from a detection unit according to an embodiment of the present invention.

In the following example, for illustrating details of a relationship between different statuses of corresponding projection image deformation and the voltage signal outputted by the detection unit, it is assumed that no relative tilt is present between a laser emitted from the optical projection system 10 and the projection plane 13 when the projection image is a rectangle. FIG. 3 shows a schematic diagram of a relationship between a first type of projection image deformation and a voltage signal outputted by a detection unit according to an embodiment of the present invention.

In the first type of projection image deformation, a relative tilt is present between a laser emitted from the optical projection system 10 and the projection plane 13. With respect to a scan sequence of the scan lines, due to the tilt, projection positions on the projection plane 13 corresponding to antecedent scan lines are relatively closer to the optical projection system 10. Taking an example of a scan sequence of scan lines from top to bottom along the vertical direction for instance, an upper part of the projection plane 13 is tilted to be relatively closer to the optical projection system 10, such that a projection image 31 is deformed into a trapezoidal image having a narrower upper base and a wider lower base, as shown in FIG. 3.

Since the projection positions on the projection plane 13 corresponding to the antecedent scan lines are tilted to be relatively closer to the optical projection system 10, distances of paths from the projection plane 13 reflecting the detection laser to the detection unit 14 receiving the reflected detection laser also change according to the scan sequence of the scan lines. For the antecedent scan lines, the distances of the paths from the projection plane 13 reflecting the detection laser to the detection unit 14 receiving the reflected detection laser are relatively shorter; for the succedent scan lines, the distances of the paths from the projection plane 13 reflecting the detection laser to the detection unit 14 receiving the reflected detection laser are relatively longer. Therefore, the intensity of the detection laser received by the detection unit 14 also changes according to the scan sequence of the scan line. More specifically, the intensities of the detection laser of the antecedent scan lines are higher, whereas the intensities of the detection laser of the succedent scan lines are lower. Hence, the levels of the voltage signals outputted by the detection unit 14 for the detection laser of the antecedent scan lines are higher, whereas the levels of the voltage signals outputted by the detection unit 14 for the detection laser of the succedent scan lines are lower.

Further, since the starting positions and the ending positions of the scan lines on the projection plane 13 remain unchanged relative to the position of the optical projection system 10, the intensities of the detection laser received by the detection unit 14 within the scan period corresponding to the same scan line are substantially equal. For example, assuming that the scan direction of one single scan line is horizontally from the left to right, the left and right sides of the projection plane 13 relative to the optical projection system 10 are not tilted. Thus, within the scan period of the same scan line, the intensities of the detection laser received by the detection unit 14 are substantially equal, the voltage levels of the voltage signals outputted by the detection signal 14 are substantially equal, and the starting voltage level and the ending voltage level of the voltage signal are also substantially equal.

As shown in FIG. 3, the scan line a has a corresponding voltage signal Va, and the scan line b has a corresponding voltage signal Vb, with the scan sequence of the scan line a being before that of the scan line b. As previously described, within the scan period of the same scan line, the voltage levels of the corresponding voltage signals are substantially equal, and the starting voltage level and ending voltage level of the voltage signal are also substantially equal. Hence, the starting voltage level Vsa and the ending voltage level Vea of the voltage signal Va are substantially equal, and the starting voltage level Vsb and ending level voltage Veb of the voltage signal Vb are also substantially equal.

Further, as the projection positions on the projection plane 13 corresponding to the antecedent scan lines are tilted to be relatively closer to the optical projection system 10, the levels of the voltage signals correspondingly outputted by the detection unit 14 for the antecedent scan lines are higher, whereas the levels of the voltage signals correspondingly outputted by detection unit 14 for the succedent scan lines are lower. Hence, the voltage signal Va corresponding to the antecedent scan line a has a higher starting voltage level Vsa, whereas the voltage signal Vb corresponding to the succedent scan line b has a lower starting voltage level Vsb, as shown in FIG. 3.

On the other hand, in the first type of projection image deformation, with respect to the scan sequence of scan lines, the relative tilt between the laser emitted by the optical projection system 10 and the projection plane 13 may also be considered as the projection positions on the projection plane 13 corresponding to the succedent scan lines are tilted to be relatively closer to the optical projection system 10. For example, assuming that the scan sequence of the scan lines is vertically from top to bottom, the lower part of the projection plane 13 is tilted to be relatively closer to the optical projection system 10.

In the above situation, same as the previous situation, within the scan period of one single scan line, the voltage levels of the corresponding voltage signals are substantially equal, and the starting voltage level and the ending voltage level of the voltage signal are also substantially equal. However, as the direction of the tilt is opposite in the current situation from the previous situation, a difference in this example is that the levels of the voltage signals correspondingly outputted by the detection unit 14 for the antecedent scan lines are lower, whereas the levels of the voltage signals correspondingly outputted by the detection unit 14 for the succedent scan lines are higher. Hence, the voltage signals corresponding to the antecedent scan lines have lower starting voltage levels, whereas the voltage signals corresponding to the succedent scan lines have higher starting voltage levels.

Based on the above characteristics, the signal control processing unit 15 determines whether the first type of projection image deformation occurs according to a difference between the starting voltage level of the voltage signal corresponding to the antecedent scan line and the starting voltage level of the voltage signal corresponding to the succedent scan line, and to accordingly determine whether to perform a correction operation. In an embodiment, the signal control processing unit 15 may set a first predetermined value, and compare whether the difference between the starting voltage level of the voltage signal corresponding to the antecedent scan line and the starting voltage level of the voltage signal corresponding to the succedent scan line exceeds the first predetermined value. When the difference exceeds the first predetermined value, it is determined that the first type of projection image deformation occurs, and the correction operation is performed for the projection image.

Further, in the first type of projection image deformation, within the scan period of the same scan line, the voltage levels of the voltage signal are substantially equal. Therefore, in an alternative embodiment, apart from comparing the starting voltage levels of the voltage signals, the ending voltage levels or the average voltage levels of the voltage signals, or the voltage levels of the voltage signals at an arbitrary point within the scan period of the scan line can also be compared.

Figure 4:
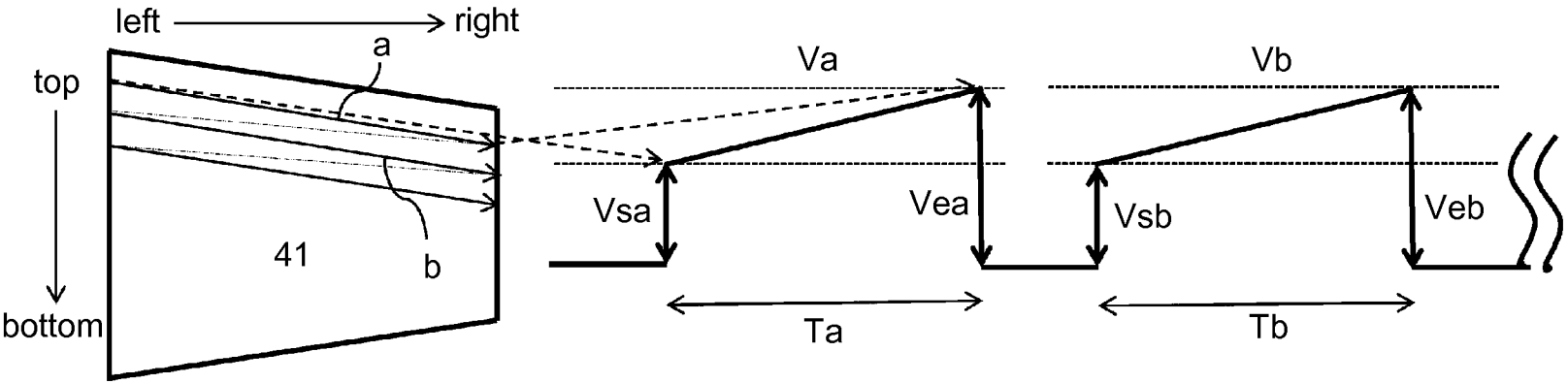
FIG. 4 is a schematic diagram of a relationship between a second type of projection image deformation and a voltage signal from a detection unit according to an embodiment of the present invention.

FIG. 4 shows a schematic diagram illustrating a relationship between a second type of projection image deformation and a voltage signal outputted by a detection unit according to an embodiment of the present invention.

In the second type of projection image deformation, a tilt is present between the laser emitted by the optical projection system 10 and the projection plane 13. Further, with respect to the scan direction of the same scan line, due to the tilt, a projection position on the projection plane 13 corresponding to an ending point of one single scan line is tilted to be closer to the optical projection system 10. For example, assuming that the scan direction of one single scan line is from left to right, the right side of the projection plane 13 is tilted to be relatively closer to the optical projection system 10, such that a projection image 41 is deformed into a trapezoidal image having a smaller right base and a greater left base, as shown in FIG. 4.

On the projection plane 13, since the ending position corresponding to the same scan line is tilted to be relatively closer to the optical projection system 10, a distance of a path from the projection plane 13 reflecting the detection laser to the detection unit 14 receiving the reflected detection laser changes according to the scan positions of the same scan line. That is to say, for the ending position of the same scan line, the distance of the path from the projection plane 13 reflecting the detection laser to the detection unit 14 receiving the reflected detection laser is relatively shorter; for the starting position of the same scan line, the distance of the path from the projection plane 13 reflecting the detection laser to the detection unit 14 receiving the reflected detection laser is relatively longer. Hence, the intensity of the detection laser received by the detection unit 14 also changes according to the scan positions of the same scan line. More specifically, the intensity of the detection laser from the ending position of the same scan line is relatively higher, whereas the intensity of the detection laser from the starting position of the same scan line is relatively lower. Thus, the ending voltage level of the voltage signal correspondingly outputted by the detection unit 14 for the ending position of the same scan line is relatively higher, whereas the starting voltage level of the voltage signal correspondingly outputted by the detection unit 14 for the starting position of the same scan line is relatively lower. As a result, for the same scan line, the starting voltage level is lower than the ending voltage level.

As shown in FIG. 4, the scan line a has a corresponding voltage signal Va, and the scan line b has a corresponding voltage signal Vb, with the scan sequence of the scan line a being before that of the scan line b. As previously described, for the same scan line, the starting voltage level is lower than the ending voltage level. Therefore, the starting voltage level Vsa of the voltage signal Va is lower than the ending voltage level Vea. Similarly, the starting voltage level Vsb of the voltage signal Vb is lower than the ending voltage level Veb.

Further, as the positions of the starting position of the antecedent scan line and the starting position of the succedent scan line relative to the optical projection system 10 are unchanged, the intensities of the detection laser corresponding to the starting positions of different scan lines and received by the detection unit 14 are substantially equal. Similarly, the intensities of the detection laser corresponding to the ending positions of different scan lines and received by the detection unit 14 are substantially equal. Hence, the starting voltage level Vsa of the voltage signal Va of the antecedent scan line a and the starting voltage level Vsb of the voltage signal Vb of the succedent scan line b are substantially equal; the ending voltage level Vea of the voltage signal Va of the antecedent scan line a and the ending voltage level Veb of the voltage signal Vb of the succedent scan line b are substantially equal, as shown in FIG. 4.

On the other hand, in the second type of projection image deformation, with respect to the scan direction of the same scan line, a tilt is present between the laser emitted by the optical projection system 10 and the projection plane 13, in a way that the projection plane 13 corresponding to the starting position of the same scan line is tilted to be relatively closer to the optical projection system 10. For example, assuming that the scan direction of the scan line is from the left to right, the left side of the projection plane 13 is tilted to be relatively closer to the optical projection system 10.

In the above situation, similar to the previous situation, the starting voltage level of the voltage signal of the antecedent scan line and the starting voltage level of the voltage signal of the succedent scan line are substantially equal, and the ending voltage level of the voltage signal of the antecedent scan line and ending voltage level of the voltage signal of the succedent scan line are substantially equal. However, due to the opposite tilting direction, a difference of the current situation from the previous situation is that, the starting voltage level of the voltage signal correspondingly outputted by the detection unit 14 for the starting position of the same scan line is relatively higher, whereas the ending voltage level of the voltage signal correspondingly outputted by the detection unit 14 for the ending position of the same scan line is relatively lower. Hence, the voltage signal corresponding to the starting position of the same scan line has a higher starting voltage level, whereas the voltage signal corresponding to the ending position of the same scan line has a lower ending voltage level.

Based on the above characteristics, the signal control processing unit 15 determines whether the second type of projection image deformation occurs according to a difference between the starting voltage level and the ending voltage level of the voltage signal corresponding to the same scan line, and to accordingly determine whether to perform a correction operation on the projection image. In an embodiment, the signal control processing unit 15 may set a second predetermined value, and compare whether the difference between the starting voltage level and the ending voltage level of the voltage signal corresponding to the same scan line exceeds the second predetermined value. When the difference exceeds the second predetermined value, it is determined that the second type of projection image deformation occurs, and the correction operation is performed on the projection image.

Figure 5:
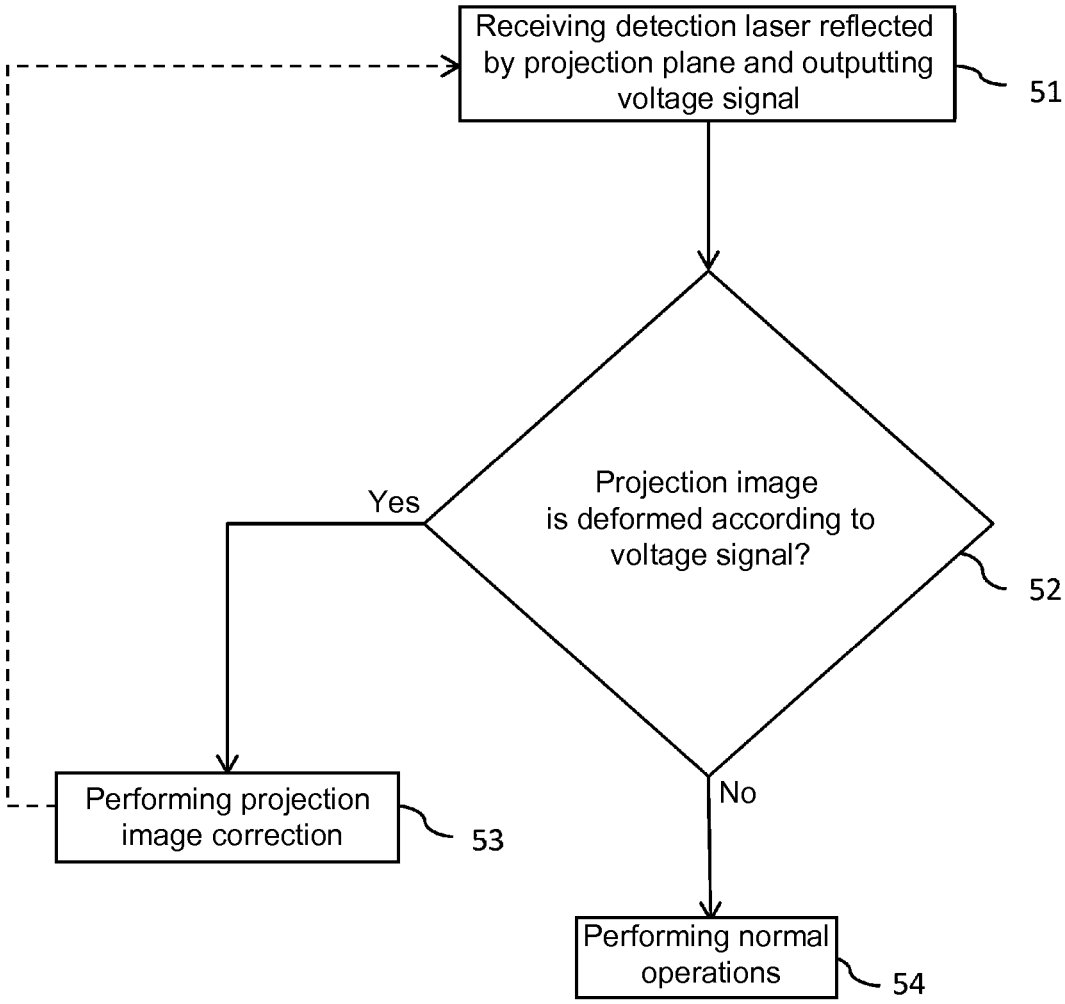
FIG. 5 is a flowchart of a method for detecting projection image deformation according to an embodiment of the present invention.

FIG. 5 shows a flowchart of a method for detecting projection image deformation according to an embodiment of the present invention. In step 51, when the detection laser driven by the scan unit 12 scans back-and-forth on the projection plane 13, the detection unit 14 receives the detection laser reflected by the projection plane 13, and outputs a voltage signal to the signal control processing unit 15 according to the intensity of the reflected detection laser received. In step 52, the signal control processing unit 15 determines whether deformation occurs in the projection image according to the received voltage signal. In step 53, when it is determined that deformation occurs in the projection image, a correction control signal is outputted to perform a correction operation on the projection image. In step 54, when it is determined that deformation does not occur in the projection image, the projection system 10 continues normal operations.

In step 52, the signal control processing unit 15 determines whether projection image deformation occurs in the projection image according to a difference between the starting voltage level and the ending voltage level of the voltage signal corresponding to the same scan line, or according to a difference between the voltage level of the voltage signal corresponding to an antecedent scan line and the voltage level of the voltage signal corresponding to a succedent scan line.

In an alternative embodiment, in step 52, when the signal control processing unit 15 outputs the correction control signal to perform the correction operation on the projection image, the optical projection system 10 may iterate step 51 to receive the detection laser reflected by the projection plane 13 and output the corresponding voltage signal. The process then enters step 52, in which the signal control processing unit 15 determines whether deformation persists in the projection image according to the received voltage signal. When it is determined that deformation still occurs in the projection image, step 53 is performed to continue the correction operation on the projection image until the projection image is no longer deformed, followed by performing step 54 for normal operations. Thus, the projection system 10 achieves an auto-correction function for the projection image.

In an embodiment of the present invention, the detection for projection image deformation may be simultaneously activated upon activating an optical projection system. Further, the detection for projection image deformation may also be configured to activate on a periodical or non-periodical basis. The detection and correction function may also be set to be turned off after having performed the detection and correction, and again be activated when a user later discovers projection image deformation. In addition, the detection and correction functions may be performed before or while the optical projection system projects the projection image.

While the invention has been described by way of example and in terms of the preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An optical projection system capable of detecting projection image deformation, comprising:

a laser source system, for generating at least one visible laser beam having a visible wavelength and a detection laser beam;

a scan unit, for projecting the visible laser beam and the detection laser beam onto a projection plane, and driving the visible laser beam and the detection laser beam to scan along a plurality of scan lines to form a projection image;

a detection unit, for detecting the detection laser beam reflected by the projection plane, and outputting a voltage signal; and a signal control processing unit, for determining whether the projection image is deformed according to the voltage signal and accordingly determining whether to perform a correction operation, wherein the detection unit outputs a first voltage signal corresponding to a first scan line among the scan lines, and the signal control processing unit determines whether the projection image is deformed according to a starting voltage level and an ending voltage level of the first voltage signal.

2. The optical projection system according to claim 1, wherein the signal control processing unit determines that the projection image is deformed when a difference between the starting voltage level and the ending voltage level of the voltage signal exceeds a predetermined value.

3. An optical projection system capable of detecting projection image deformation, comprising:

a laser source system, for generating at least one visible laser beam having a visible wavelength and a detection laser beam;

a scan unit, for projecting the visible laser beam and the detection laser beam onto a projection plane, and driving the visible laser beam and the detection laser beam to scan along a plurality of scan lines to form a projection image;

a detection unit, for detecting the detection laser beam reflected by the projection plane, and outputting a voltage signal; and a signal control processing unit, for determining whether the projection image is deformed according to the voltage signal and accordingly determining whether to perform a correction operation, wherein the detection unit outputs a first voltage signal and a second voltage signal corresponding to a first scan line and a second scan line among the scan lines and the signal control processing unit determines whether the projection image is deformed according to voltage levels of the first voltage signal and the second voltage signal.

4. The optical projection system according to claim 3, wherein the signal control processing unit determines that the projection image is deformed when a difference between the voltage levels of the first voltage signal and the second voltage signal exceeds a predetermined value.

5. The optical projection system according to claim 3, wherein the voltage level is a starting voltage level, an ending voltage level or an average voltage level.

6. The optical projection system according to claim 1, wherein the detection laser beam has an invisible wavelength.

7. A method for detecting projection image deformation, applied to an optical projection system, comprising:

projecting a detection laser beam onto a projection plane, and driving the detection laser beam to scan along a plurality of scan lines to form a projection image;

detecting the detection laser beam corresponding to a first scan line among the scan lines reflected by the projection plane, and outputting a first voltage signal; and determining whether the projection image is deformed according to a starting voltage level and an ending voltage level of the first voltage signal and further accordingly determining whether to perform a correction operation.

8. The method according to claim 7, wherein the detection laser beam has an invisible wavelength.

9. The method according to claim 7, further comprising determining that the projection image is deformed when a difference between the starting voltage level and the ending voltage level exceeds a predetermined value.

10. A method for detecting projection image deformation, applied to an optical projection system, comprising:

projecting a detection laser beam onto a projection plane, and driving the detection laser beam to scan along a plurality of scan lines to form a projection image;

detecting the detection laser beam corresponding to a first scan line and a second scan line among the scan lines reflected by the projection plane, and outputting a first voltage signal and a second voltage signal; and determining whether the projection image is deformed according to voltage levels of the first voltage signal and the second voltage signal and further accordingly determining whether to perform a correction operation.

11. The method according to claim 10, wherein said determining includes determining that the projection image is deformed when a difference between the voltage levels of the first voltage signal and the second voltage signal exceeds a predetermined value.

12. The method according to claim 10, wherein the voltage level is a starting voltage level, an ending voltage level or an average voltage level.

* * * * *